US011837401B2

(12) United States Patent
Bebek et al.

(10) Patent No.: US 11,837,401 B2
(45) Date of Patent: Dec. 5, 2023

(54) ACTUATION SYSTEM TO ACHIEVE SOFT LANDING AND THE CONTROL METHOD THEREOF

(71) Applicant: OZYEGIN UNIVERSITESI, Istanbul (TR)

(72) Inventors: Ozkan Bebek, Istanbul (TR); Muhammad Sarmad Qureshi, Istanbul (TR); Mehmet Polat Kuntuz, Istanbul (TR); Ozgur Ertunc, Istanbul (TR); Ismail Hakki Savci, Istanbul (TR); Tahsin Hacibekir, Istanbul (TR)

(73) Assignee: OZYEGIN UNIVERSITESI, Istanbul (TR)

( * ) Notice: Subject to any disclaimer, the term of this patent is extended or adjusted under 35 U.S.C. 154(b) by 455 days.

(21) Appl. No.: 17/293,048

(22) PCT Filed: Nov. 12, 2018

(86) PCT No.: PCT/TR2018/050681

§ 371 (c)(1),
(2) Date: May 12, 2021

(87) PCT Pub. No.: WO2020/101580

PCT Pub. Date: May 22, 2020

(65) Prior Publication Data

US 2021/0398725 A1 Dec. 23, 2021

(51) Int. Cl.

| | |
|---|---|
| ***H01F 7/18*** | (2006.01) |
| ***H01F 7/06*** | (2006.01) |
| ***H01F 7/08*** | (2006.01) |

(52) U.S. Cl.
CPC ..... *H01F 7/18* (2013.01); *H01F 7/064* (2013.01); *H01F 7/081* (2013.01)

(58) Field of Classification Search
CPC . H01F 7/18; H01F 7/064; H01F 7/081; H01F 2007/1894
See application file for complete search history.

(56) References Cited

U.S. PATENT DOCUMENTS

| | | | | |
|---|---|---|---|---|
| 6,176,207 | B1 * | 1/2001 | Wright | F01L 9/20 123/90.11 |
| 6,681,728 | B2 * | 1/2004 | Haghgooie | F01L 9/20 123/90.11 |
| 10,665,373 | B2 * | 5/2020 | Pessina | H01F 7/064 |
| 2010/0193719 | A1 * | 8/2010 | Bartel | F02D 41/20 251/129.01 |

FOREIGN PATENT DOCUMENTS

| | | | | |
|---|---|---|---|---|
| DE | 102007003211 | A1 * | 7/2008 | F02D 41/20 |
| DE | 102011116872 | A1 * | 5/2013 | H01F 7/18 |

* cited by examiner

*Primary Examiner* — Mohamad A Musleh
(74) *Attorney, Agent, or Firm* — Bayramoglu Law Offices LLC

(57) ABSTRACT

An actuation system to achieve soft landing and the control method thereof are provided. A soft landing is achieved via an open loop control of an electromagnetic actuator. The actuation system includes a control unit, wherein the control unit controls the electromagnetic actuator. The control unit does not rely on sensor data regarding a position of an armature to achieve the soft landing. As the actuation system achieves soft landing via the open loop control of the electromagnetic actuator by the control unit, a use of the sensor data is not needed.

11 Claims, 1 Drawing Sheet

ACTUATION SYSTEM TO ACHIEVE SOFT LANDING AND THE CONTROL METHOD THEREOF

CROSS REFERENCE TO THE RELATED APPLICATIONS

This application is the national stage entry of International Application No. PCT/TR2018/050681, filed on Nov. 12, 2018, the entire contents of which are incorporated herein by reference.

TECHNICAL FIELD

The present invention relates to an actuation system and a method for controlling the movement of an armature of the electromagnetic actuator.

BACKGROUND

Electromagnetic actuators including the solenoid are also called variable reluctance actuators. In these devices we find a movable element made of either a ferromagnetic material, a magnet, or both, that has a force exerted on it by a magnetic field which has been generated by an electrical current flowing in a coil of wire. There may also be a permanent magnet in the non-moving component, and the coil then either adds to or reduces the force produced by the magnet. The coil is also typically wound on a ferromagnetic material to increase the efficiency and force.

Electromechanical actuators are replacing pneumatic and hydraulic actuators as they provide more reliable and accurate control, they are more efficient and less hazardous to the environment. Moreover, compactness along with rugged, simple in construction and lower cost makes them suitable to be used in many domestic and commercial applications, which require on and off linear physical movements. The motion is induced by the current supplied to a coil of wire, which then give rise to an electromagnetic force, then this force is used to control the motion of the electromechanical actuator being controlled.

In the last two decades, many control schemes have been developed that yield higher accuracy for the position control of the electromagnetic solenoid actuators. However, due to the extremely nonlinear behaviour of the electromagnetic solenoid actuator, a robust control technique that caters all the non-linearities is needed to achieve tracking with high precision. For that reason, different control algorithms can be applied to the physical hardware to control the electromechanical solenoid actuator. Besides the precise position control of the electromechanical actuator, another technical problem that should be considered is the high landing velocity of the actuator's moving part, known as the armature or plunger, which may cause excessive wear, high noise and increased actuator stress. In addition to the aforesaid problems, it will also induce armature bounce, which may cause uncertainties in the output leading to the poor performance of the physical hardware.

The electromechanical actuator has many industrial applications in the various engineering fields that require fast and linear motion. For instance, inside an automatic gearbox drive selector, actuators help the drive selection process. Other applications may include anti-vibration engine mountings, air conditioning control and locking mechanisms. Moreover, they are also used in the agriculture machinery for the spraying of the chemicals for the pest control. In medical field, electromechanical actuator applications are numerous; they are essential components for the dialysis machines, as two solenoids are used to control the blood flow of a person during dialysis.

In the industry electromechanical actuators are vital components in many of the industrial machines, can be found in devices that demand positioning, locking, holding, and rotation. They are also used to control the water pressure in the sprinkler systems and many of such applications.

When energized, the electromechanical actuator stores the kinetic energy in the spring, which is then released when the electromechanical actuator is de-energized. The elastic energy stored in the spring accelerates the motion which causes the high landing velocity and causes high-velocity impact and problems associated with it. Therefore, to overcome this problem, seating velocity can be reduced with different control algorithms and techniques, to achieve the soft landing of the electromechanical solenoid actuator. By achieving soft landing of the actuator of EM solenoid actuator, life of the mechanical parts of the EM solenoid actuator can be increased and the aforesaid problems can be minimized.

In the state of the art European Patent Application No. EP0973178, a method for controlling the movement of an armature of an electromagnetic actuator, particularly for operating a charge cycle lifting valve of an internal-combustion engine, in which the armature oscillates between two solenoid coils against the force of at least one restoring spring, in response to alternating energizing of the solenoid coils.

In the state of the art German Patent Application No. DE10012988, a process for operating an electromagnetic actuator and, more particularly, to a process for actuating a gas exchange lift valve of an internal combustion engine, with an armature, which is moved oscillating between two electromagnetic coils against the force of at least one return spring via an alternating supply of current to the electromagnetic coils.

In the state of the art U.S. Pat. No. 6,249,418, provides for the control of the position of, or force on an electromagnetic actuator using the minimum possible amount of information from the system.

SUMMARY

The aim of the present invention is open loop control of an electromagnetic solenoid actuator to achieve soft landing.

In accordance with the present invention the soft landing is achieved via sensorless control of the electromagnetic actuator. The actuation system comprises a control unit which inputs the operating voltage to at least one electromagnetic actuator, due to which coil of the EM solenoid actuator can be energized or de-energized. Said control unit does not rely on sensor data regarding the position of the armature to achieve soft landing. As the invention provides an intelligent sensorless PWM voltage actuation to the EM solenoid actuator, which helps in achieving the lower seating velocities at the time of closing of solenoid actuator In accordance with the current invention the control unit applies a first portion of a voltage signal to energize the coil of the electromagnetic actuator. Accordingly, the armature moves. After the voltage signal is stopped the armature remains in position for a period while there still a magnetic field in the coil. Once such admittance time has elapsed the armature starts moving in the reverse direction as the magnetic force is no longer acting on it to hold the armature in position. At this instant the control unit applies a second portion of voltage on the armature. Accordingly, armature does not fall at a high speed, but a soft landing is achieved in as described an open loop control manner. Hence the negative effects of a speedy fall of the armature such as excessive and undesirable operational noise, damage to the armature, and uncertainty in the output due to plunger bounce is minimized.

The time of the application ($T_{wait}$) of the second portion of the voltage and duration ($T_{width}$) of application of the said second portion is important to achieve the ideal soft-landing results. The values for the time of the application of the second portion and duration of the second voltage portion shall be determined in accordance with the particular characteristics of the actuator to be used by the manufacturer.

The decision with respect to the timing of the application ($T_{wait}$) of the second voltage signal relates to the admittance time (T5) and the time needed for reverse movement (closing) of the armature (T6) for the particular actuator used by the manufacturer. After all to achieve soft landing, the second portion of the voltage shall be applied after the completion of the admittance time and before the closing of the armature. Hence the time for the application of the second portion of the voltage signal can be calculated by adding the admittance time and a constant ('A') times the time needed for closing. Similarly, the duration of the application of the second portion of the voltage signal ($T_{width}$) is a constant ('B') times the time for actuator to reach its maximum (T2) when the actuator is energized, as a result of the application of the first portion of the voltage signal and shall be calculated by the manufacturer in accordance with the specific technical features of the actuator such as the weight, the length and the material of the armature.

In a particular embodiment of the invention the above-mentioned constants to calculate the time and the duration of the application of the second portion of the voltage have been calculated for a particular actuator that has been used. It has been identified the second portion of the voltage shall be applied after the admittance time has been completed, in addition with the %33 of the time for the closing of the armature has been elapsed i.e. "A" is taken as 0.33. For the same actuator the second voltage portion shall be applied for a duration that is %50 of the time for the actuator to reach its maximum i.e. "B" is taken as 0.5. Such values can be used with a 5-10% tolerance and still same results would be achieved in terms of soft landing.

The first portion could be of any length depending on the user desire to keep the actuator open. So, if you need the actuator to remain open for 2 seconds, then the length of the first portion will be 2 seconds long. Second portion helps to achieve the soft landing of the solenoid actuator. The reason for the multiplication of the 'A' with closing time and multiplication of 'B' with opening time is to ensure that the small signal is applied at the right time and for the right time to achieve the optimum results. In this way the small portion can be applied to the solenoid to achieve soft landing of the actuator after the main portion finishes. The physical and electromagnetic parameters effect the $T_{wait}$ and $T_{width}$ and correspondingly effect the constant values 'A' and 'B'. Width of the second portion of the signal directly depends upon the constant 'B', which came out in our tests to be 0.5 for the actuator used. This means that value of 'B' is half of the signal time that can open closed position armature to the fully open position. The value of constant B can be lower for the armatures that have lighter weight because lighter weight armatures have lower momentum to slow down. Physical parameters play a vital role in determining the values of these constants, similarly the other parameters will affect the values of the constants A and B. In the waiting formula, T5 is the time for reactivation of the armature after the power is turned off. The coefficient 'A' helps to ensure that this deceleration signal is delivered at the right time. If it is given early, the armature will just stay open longer and if given late, the armature will close before slowing down effect.

As explained above the present invention discloses a pulse width modulated (PWM) actuation signal as well as a method of control for an actuation system of EM solenoid actuator, which is an open loop system that does not need sensor data to determine the position of the armature for soft landing. Accordingly, soft landing is assured with lower cost i.e. no extra circuitry or hardware is required, for minimizing the unwanted effects of the hard landing.

The present invention has many application areas that are including but not limited to the automotive, robotics and medical industries especially with respect to production lines and automation.

BRIEF DESCRIPTION OF THE DRAWINGS

The electromagnetic actuator realized in order to attain the aim of the present invention is illustrated in the attached figures, where.

The elements illustrated in the figures and the steps are numbered as follows:

1. Actuation system
2. Electromagnetic actuator
3. Armature (Plunger)
4. Coil
5. Control unit The following symbols are used so that the present invention is understood better:

T1. The time required to build magnetic force to pull the armature via the first portion of the voltage signal.
T2. The time for the movement of the armature via the first portion of the voltage signal.
T3. The opened position of the armature caused by the voltage signal.
T4. The closing time of the first portion of the voltage signal.
T5. The admittance time.
T6. The movement of the closing of the armature.
T7. The second portion of the voltage signal duration.

DETAILED DESCRIPTION OF THE EMBODIMENTS

Figure 1:
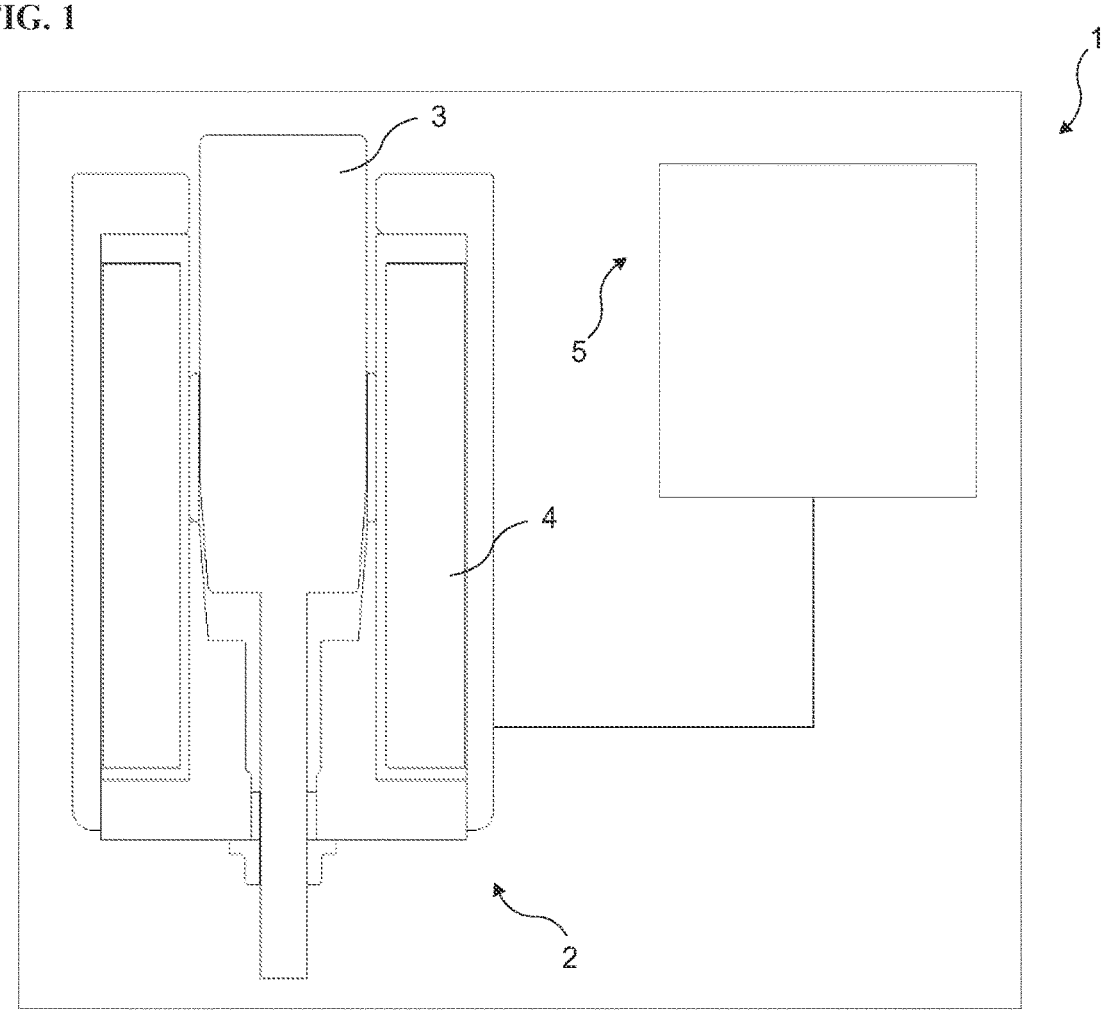
FIG. 1—is the schematic view of an electromagnetic actuator.

The actuation system (1) comprising an electromagnetic actuator (2) which comprises a body, at least one coil (4), an armature (3) to convert electrical energy into mechanical energy and a control unit (5) that applies the voltage signal to the electromagnetic actuator (2) on the coil (4) for the open loop control of the electromagnetic actuator (2) to achieve soft landing and wherein a first portion of the said voltage signal is applied to energize the coil (4) and a second portion of the voltage signal is applied after the first voltage signal is closed and the admittance time is finished to generate a soft-landing of the armature (3) and, wherein the second portion of the voltage is applied for a period of time shorter than the period of application of the first portion of the voltage signal (FIG. 1).

The control unit (5) of the present invention applies the voltage in two portions. The first portion of the voltage signal energizes the electromagnetic actuator (2), which causes the movement of the armature (3) while necessary holding force is achieved. After the first portion of the voltage signal ends, the residual magnetism begins to die, and the holding force weakens accordingly. As a result, the armature (3) starts moving in the opposite direction. Meanwhile the control unit (5) applies the second portion of the voltage signal which helps in the soft-landing process of the armature (3) of the electromagnetic actuator (2). The second portion of the voltage signal is a surge applied at a specific point and for a specific time, which is determined by the certain electromagnetic actuator's (2) parameters.

In a particular embodiment of the present invention the voltage signal is a pulse width modulation (PWM) signal.

In an embodiment of the present invention, the magnitudes of the first and second portion of the voltage signals are equal to each other.

In another embodiment of the present invention, the waiting time between the first portion and the second portion of the voltage signal ($T_{wait}$) has been calculated by adding the period of time required to reach the admittance of the electromagnetic actuator (2) after the first portion of the voltage signal is finished ($T_5$) and the period of time required for the closing of armature (3)($T_6$) multiplied with a constant value which is determined by the manufacturer according to the certain electromagnetic actuator's (2) parameters (A).

$$T_{wait}=T_5+A*T_6$$

Then the second portion of the voltage signal is applied for a period of time ($T_{width}$) that has been calculated by the multiplication of a constant value which is determined by the producer according to the certain electromagnetic actuator's (2) parameters (B) with the time for electromagnetic actuator (2) to reach its maximum or the movement of the armature (3) ($T_2$).

$$T_{width}=B*T_2$$

For different embodiments of the invention values of A and B shall be determined according to the actuator (2) type that is being used. Once the preferred value for A and B is determined the working range to be determined for the A and B values by taking a plus minus 5-10% margin into account. All these values depend on the physical parameters and electromagnetic properties of the electromagnetic actuators (2). These parameters are different for different electromagnetic actuators (2). Physical parameters and electromagnetic properties that affect the $T_{wait}$ and $T_{width}$ are: Materials used, mass of armature (3), no. of turns of the coil (4), springs constant, coil (4) resistance. If the physical parameters of the solenoid are known, then one can create an electromechanical model of the solenoid to simulate the motion of the armature (3), in accordance with the given voltage input. By checking the simulation results one can infer, what these constants 'A' and 'B' are.

In the preferred embodiment of the present invention, the "A" value for the particular actuator (2) used has been observed to be 0.33 and "B" value has been observed to be 0.5 to achieve soft-landing. Similarly, the working range of the A and B values for this particular actuator (2) can be calculated by using a 5-10% margin from the observed A value and B values simultaneously. The range of 'A' and 'B' is in between 0.1 and 0.9.

Figure 2:
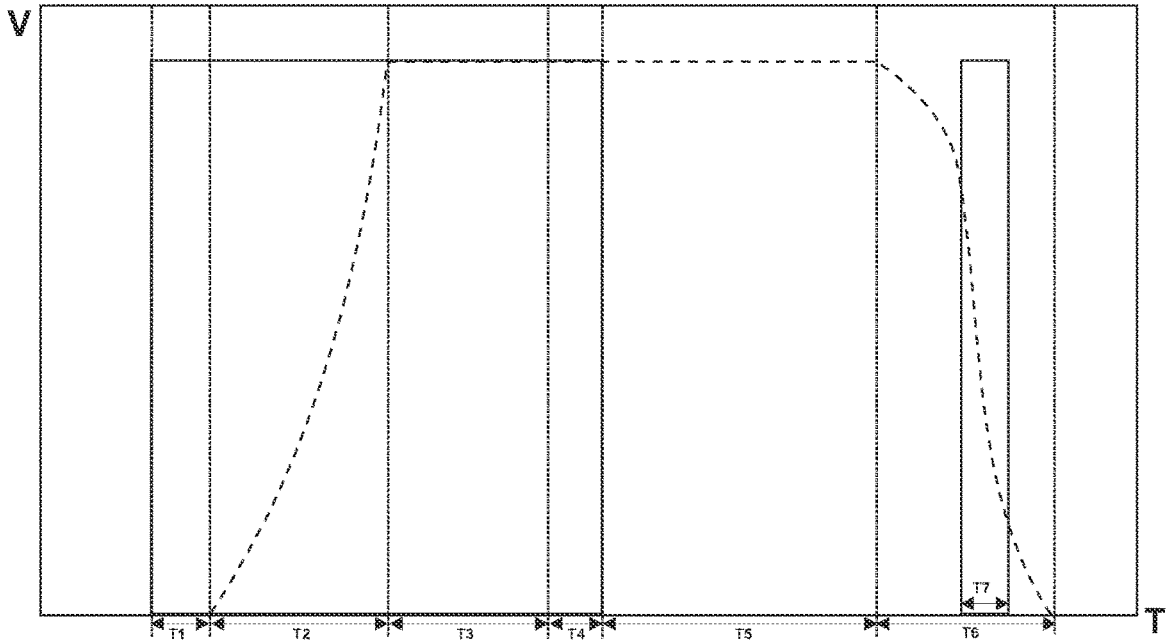
FIG. 2—is the voltage profile for control of an electromagnetic actuator.

In the preferred embodiment of the present invention, electromagnetic actuator (2) is operated 24 V DC (FIG. 2).

The control method of the present invention used in the above-disclosed actuation system (1) and executed by the control unit (5), comprises the following steps for providing a soft-landing of the armature (3), applying the first portion of the voltage signal for the energization of the coil (4) by control unit (5), after the end of the application of the first portion of the voltage waiting for the completion of an admittance time, after the admittance time is completed, while the armature (3) is closing applying the second portion of the voltage signal.

According to the present invention cost effective and easy open loop control method for the movement of the armature (3) is provided. As the system, contrary to the closed loop systems known in the art, does not rely on the position feedback from the encoders, the resulting soft landing is comparatively easy to achieve when the output is difficult to measure and is more stable. Further as there is no need to use sensors to obtain the position data, it is more cost-effective. Additionally, the lifespan of electromagnetic actuator (2) is increased, and undesirable operational noise is much reduced.

What is claimed is:

1. An actuation system, comprising an electromagnetic actuator, wherein the electromagnetic actuator comprises a body, at least one coil, and an armature to convert an electrical energy into a mechanical energy, a control unit, wherein the control unit applies a voltage signal to the electromagnetic actuator on the at least one coil for an open loop control of the electromagnetic actuator to achieve a soft landing, wherein a first portion of the voltage signal is applied to energize the at least one coil, a second portion of the voltage signal is applied after the voltage signal is closed and an admittance time is finished to generate the soft landing of the armature (3) and, the second portion of the voltage is applied for a period of time shorter than a period of application of the first portion of the voltage signal.

2. The actuation system according to claim 1, wherein magnitudes of the first portion of the voltage signal and the second portion of the voltage signal are equal to each other.

3. The actuation system according to claim 1, wherein a waiting time between the first portion and the second portion of the voltage signal is $T_{wait}$ and $T_{wait}$ is calculated by adding the period of time required to reach an admittance of the electromagnetic actuator after the first portion of the voltage signal is finished and a period of time required for a closing of the armature multiplied with a first, constant value, wherein the first constant value is determined by a manufacturer according tofirst parameters of the electromagnetic actuator.

4. The actuation system according to claim 3, wherein the second portion of the voltage signal is applied for a period of time $T_{width}$ and $T_{width}$ and is calculated by a multiplication of a second constant value, wherein the second constant value is determined by a producer according to second parameters of the electromagnetic actuator with a time for the electromagnetic actuator to reach a maximum of the electromagnetic actuator or a movement of the armature.

5. The actuation system according to claim 4, wherein the first constant value is 0.33 and the second constant value is 0.5.

6. A method for controlling the actuation system according to claim 1, comprising the following steps:

applying the first portion of the voltage signal for an energization of the at least one coil by the control unit, after an end of the application of the first portion of the voltage signal waiting for a completion of the admittance time, after the admittance time is completed, while the armature is closing applying the second portion of the voltage signal.

7. The actuation system according to claim 2, wherein a waiting time between the first portion and the second portion of the voltage signal is $T_{wait}$ and $T_{wait}$ is calculated by adding the period of time required to reach an admittance of the electromagnetic actuator after the first portion of the voltage signal is finished and a period of time required for a closing of the armature multiplied with a first constant value, wherein the first constant value is determined by a manufacturer according to first parameters of the electromagnetic actuator.

8. The method according to claim 6, wherein magnitudes of the first portion of the voltage signal and the second portion of the voltage signal are equal to each other.

9. The method according to claim 6, wherein a waiting time between the first portion and the second portion of the voltage signal is $T_{wait}$ and $T_{wait}$ is calculated by adding the period of time required to reach an admittance of the electromagnetic actuator after the first portion of the voltage signal is finished and a period of time required for a closing of the armature multiplied with a first constant value, wherein the first constant value is determined by a manufacturer according to first parameters of the electromagnetic actuator.

10. The method according to claim 9, wherein the second portion of the voltage signal is applied for a period of time $T_{width}$ and $T_{width}$ is calculated by a multiplication of a second constant value, wherein the second constant value is determined by a producer according to second parameters of the electromagnetic actuator with a time for the electromagnetic actuator to reach a maximum of the electromagnetic actuator or a movement of the armature.

11. The method according to claim 10, wherein the first constant value is 0.33 and the second constant value is 0.5.

* * * * *